US005452857A

United States Patent [19]

Furuse et al.

[11] Patent Number: 5,452,857

[45] Date of Patent: Sep. 26, 1995

[54] BURNER FOR BURNING LIQUID FUEL

[75] Inventors: Yutaka Furuse, Chigasaki; Tuneo Miyake, Tokyo, both of Japan

[73] Assignees: Nippon Oil Company Limited; Nippon Oil Engineering and Construction Company Limited; Fuji Engineering Company Limited, all of Tokyo, Japan

[21] Appl. No.: 66,668

[22] Filed: May 25, 1993

[30] Foreign Application Priority Data

May 28, 1992 [JP] Japan ..... 4-136817

[51] Int. Cl.[6] ..... F23D 11/12

[52] U.S. Cl. ..... 239/405; 239/473

[58] Field of Search ..... 239/403, 406, 239/418, 434, 463, 468, 478, 405, 473

[56] References Cited

U.S. PATENT DOCUMENTS

| | | | |
|---|---|---|---|
| 1,980,132 | 11/1934 | Fletcher | 239/406 |
| 2,933,259 | 3/1958 | Raskin . | |
| 4,356,970 | 11/1982 | Vosper et al. | 239/403 |

FOREIGN PATENT DOCUMENTS

| | | | |
|---|---|---|---|
| 149901 | 7/1985 | European Pat. Off. | 239/403 |
| 419197A | 3/1991 | European Pat. Off. | 239/403 |
| 4525064 | 8/1970 | Japan | 239/406 |
| 138613 | 6/1987 | Japan | 239/403 |

*Primary Examiner*—Andres Kashnikow
*Attorney, Agent, or Firm*—Lowe, Price, LeBlanc & Becker

[57] ABSTRACT

A burner for burning liquid fuel is provided, which atomizes liquid fuel together with an atomizing medium mixed with the fuel. The inhibition of generation of NOx in exhaust gas and that of generation of soot and dust are caused to be compatible by the burner, and the manufacturing properties are improved and the turndown ratio is increased.

8 Claims, 3 Drawing Sheets

BURNER FOR BURNING LIQUID FUEL

BACKGROUND OF THE INVENTION

1. Field of the Invention

The present invention relates to a burner for burning liquid fuel used for a combustion device of a heating source such as a boiler, heating furnace and the like, and more particularly relates to a burner for burning liquid fuel by which liquid fuel is atomized together with an atomizing medium.

2. Related Art of the Invention

Conventionally, in the burner for burning liquid fuel, the following methods have been adopted for inhibiting the generation of nitride (referred to as NOx hereinafter): self exhaust gas recirculating system, two stage combustion method, three stage combustion method, and exhaust gas recirculating method. Also, various combustion systems have been proposed, in which water jet or steam jet is adopted or the furnace load is reduced or the combustion air temperature is lowered.

According to the aforementioned conventional combustion systems, combustion is gently conducted when the flame temperature is lowered and the oxygen concentration is reduced, and due to the effect of gentle combustion, it is expected that the generation of NOx is inhibited while the generation of a certain amount of soot and dust is allowed.

That is, in the conventional combustion systems, it is difficult to concurrently inhibit the generation of NOx and that of soot and dust.

As an example of conventional burners for burning liquid fuel, there is a burner in which the injection nozzles provided close to the burner tip are disposed at regular intervals or in an arrangement in which the injection nozzles are arranged approximately at regular intervals.

However, in this type burner, integrated flames are usually generated. Therefore, although the generation of soot and dust can be inhibited, the flame layers become thick and large, so that the radiation properties are deteriorated and the flame temperature is raised. Accordingly, the residence time of combustion gas in a high temperature region is increased. Therefore, it is impossible to inhibit the generation of NOx.

In other words, it is difficult to concurrently inhibit the generation of NOx and that of soot and dust by the conventional burner structure for burning liquid fuel.

Moreover, in order to inhibit the generation of NOx, a burner structure in which flames are divided is effective, and the smaller the division angle is, the more effect can be provided.

However, according to the aforementioned structure, it is impossible to avoid the delay of contact between the flames and air. As a result, the flame length is increased, so that a large amount of soot and dust is generated. Therefore, in the conventional burner, the generation of soot and dust is inhibited when the division angle is increased to not less than 30°. In this case, a sacrifice is made of the generation of NOx for the sake of inhibiting the generation of soot and dust.

On the other hand, a burner for burning liquid fuel is well known, in which an atomizing medium such as steam and air is mixed with liquid fuel and this mixed fluid is atomized by a plurality of injection nozzles.

In the fuel atomizing system of the aforementioned burner for burning liquid fuel, particles of liquid fuel mixed with the atomizing medium are made to be minute and dispersed by the expansion energy generated when an atomizing medium such as steam and air is injected from a side of high pressure to that of low pressure.

The following two systems are well known as the aforementioned fuel atomizing system. One is an intermixing system in which the injection amount is controlled while a difference between the pressure of atomizing medium and that of liquid fuel is maintained to be constant, and the other is an intermediate-mixing system in which the injection amount is controlled by changing the pressure of liquid fuel while the pressure of atomizing medium is maintained to be constant.

When the intermixing system and the intermediate-mixing system are compared, the intermediate-mixing system is superior to the intermixing system because the consumption of atomizing medium of the intermediate-mixing system is smaller than that of the intermixing system and more minute particles of liquid fuel can be provided.

However, the following problem is caused in the atomizing systems described above. That is, liquid fuel, which is an incompressible fluid, is not provided with dispersion force, so that the atomizing medium must be maintained at high temperature and high pressure.

Further, in the case of the intermediate-mixing system in a system in which the atomizing medium and liquid fuel are mixed with each other in a reverse-Y-shaped jet flow, particles of liquid fuel can not be made to be uniformly minute and deviation is caused in the injection nozzles, depending on the pressure and flow amount of the atomizing medium and liquid fuel. For that reason, the fuel particles are not sufficiently contacted with air, and the flame length is increased, so that the combustibility is affected.

In order to solve the aforementioned problems caused in this intermediate-mixing system, a technique has been proposed, in which liquid fuel is swirled and further dispersed by the centrifugal force so that the fuel particles can be made to be minute, and while the combustion condition is improved, the fuel particles are shorn by the atomized medium (disclosed in U.S. Pat. No. 2,933,259).

It can be considered to apply the aforementioned technique in which liquid fuel is swirled and further dispersed by the centrifugal force so that the particles of the liquid fuel can be made to be more minute and the fuel particles are shorn by the atomizing medium while the combustion condition is improved, to a burner for burning liquid fuel composed of a fuel supply member and a burner tip connected with the end portion of the fuel supply member.

In this case, it is possible to cut an injection nozzle portion on the bottom surface of the burner tip so as to form a swirling section in which liquid fuel is swirled. However, according to the aforementioned structure, a portion of the injection nozzle with respect to its longitudinal direction is used for the swirling and shearing section, so that the length of the injection nozzle is substantially reduced, and the necessary length can not be ensured for the mixing portion of the injection nozzle in which fuel and atomizing medium are mixed. Moreover, even when an atomizing angle of the injection nozzle and a division angle formed by two adjoining injection nozzles are slightly changed, it is necessary to manufacture a burner tip including the swirling section for liquid fuel which must be manufactured through a high grade of machining. Therefore, the manufacturing properties can not be improved.

Moreover, with respect to the structure to supply the atomizing medium to the injection nozzle for shearing fuel particles, it can be considered to adopt a structure in which a curved atomizing medium supply hole is formed in the fuel supply member. In this case, there is a possibility that a swirling flow of liquid fuel into the injection nozzle is obstructed by the energy of a curved flow of the atomizing medium. In order to prevent the reduction of flow energy of liquid fuel, it is necessary to increase a pressure difference between the atomizing medium and the liquid fuel. As a result of the foregoing, there is a possibility of misfire, so that the turndown ratio can not be made sufficiently high.

SUMMARY OF THE INVENTION

The present invention has been achieved in consideration of the aforementioned conventional problems, and an object of the present invention is to provide a burner for burning liquid fuel in which liquid fuel is atomized by an atomizing medium mixed with the liquid fuel, wherein the inhibition of generation of NOx in exhaust gas and that of generation of soot and dust are compatible with each other.

Another object of the present invention is to reduce the consumption of the aforementioned atomizing medium.

Yet another object of the present invention is to improve the manufacturing properties of a burner.

Still another object of the present invention is to ensure a sufficient length of the mixing portion of the injection nozzle in which fuel and atomizing medium are mixed.

A further object of the present invention is to increase a turndown ratio.

In order to accomplish the objects, the present invention is to provide a burner for burning liquid fuel comprising a fuel supply member and a burner tip connected with the end portion of the fuel supply member, the burner tip including a plurality of injection nozzles by which liquid fuel and atomizing medium mixed in the liquid fuel are atomized and injected into a combustion device, the fuel supply member including: a bottom surface cutout portion formed in the center of a bottom surface of the fuel supply member, the atomizing medium being supplied to the bottom surface cutout portion through an atomizing medium passage formed in a pipe plunged into the combustion device; an atomizing medium supply hole communicated with the bottom cutout portion and also communicated straight with a plurality of injection nozzles of the burner tip; a liquid fuel supply hole, one end portion of which is open to the periphery of the bottom surface of the fuel supply member, the other end portion of which branches in two directions, one branch being communicated with an annular space formed between the periphery of the upper surface of the fuel supply member and the lower surface of the burner tip, the other branch being communicated with an upper surface cutout portion formed in the center of the upper surface of the fuel supply member, wherein liquid fuel is supplied to the liquid fuel supply hole through the fuel passage formed in the pipe; and communicating cutout grooves that respectively communicate the annular space formed on the upper surface of the fuel supply member and the upper surface cutout portion with the side portion of the end of the atomizing medium supply hole, wherein the communicating cutout groove is connected with the side portion of the end of the atomizing medium supply hole in a tangential direction of the atomizing medium supply hole.

As a result of the foregoing, liquid fuel supplied to the fuel supply member is sent to the liquid fuel supply hole from the bottom side of the fuel supply member, and then branches and flows.

One branch of the liquid fuel flow reaches the communicating cutout groove through the upper surface cutout portion of the fuel supply member, and is injected from the inner circumferential surface position of the atomizing medium supply hole to which the communicating cutout groove is open.

The other branch of the liquid fuel flow reaches the communicating cutout groove through the annular space of the fuel supply member, and is injected from the inner circumferential surface position opposite to the other opening portion of the communicating cutout groove of the atomizing medium supply hole.

On the other hand, the atomizing medium flows into the atomizing medium supply hole from the bottom surface of the fuel supply member. The atomizing medium that has flown into the atomizing medium supply hole is injected into the injection nozzle. At this time, the liquid fuel injected from the inner circumferential surface of the injection nozzle is respectively swirled.

The atomizing medium is injected against the swirling flow of liquid fuel, so that the liquid fuel and the atomizing medium are mixed with each other and injected from the injection nozzle. At this time, the particles of liquid fuel mixed with the atomizing medium are made to be minute and dispersed uniformly by the expansion energy generated when the atomizing medium is injected from the high to the low pressure side. Also, the liquid fuel is swirled, and the particles of liquid fuel are made to be more minute and further dispersed by the action of the centrifugal force caused by this swirling motion, so that the liquid fuel is uniformly dispersed in a wide range. Moreover, since the particles of liquid fuel are shorn by the atomizing medium, the particles of liquid fuel are more effectively made to be minute.

As a result of the foregoing, the combustibility is further improved, and the generation of NOx can be inhibited while the generation of soot and dust is inhibited.

Since only the liquid fuel is swirled and the steam is not swirled, frictional energy generated between the atomizing medium and the liquid fuel is reduced, so that the consumption of the atomizing medium can be reduced.

On the other hand, the swirling section for liquid fuel and the shearing section to shear liquid fuel are provided in the fuel supply member. Therefore, as compared with a case in which the swirling section for liquid fuel is formed by a machining process in the injecting nozzle portion on the bottom surface of a burner tip, the structure of the burner tip can be simplified. Therefore, it becomes easy to manufacture the burner tip. Moreover, a portion of the injection nozzle with respect to its longitudinal direction is not taken for the swirling shearing portion, so that the mixing portion in the injection nozzle, in which fuel and atomizing medium are mixed, is sufficiently long, and the mixing properties can be improved. Moreover, in the case where the atomizing angle of the injection nozzle and the division angle formed by two adjoining injection nozzles are slightly changed, the grade of machining is not high, so that the manufacturing properties of the burner tip can be improved.

Moreover the atomizing medium can be sent straight to the injection nozzle of the burner tip from the center of the fuel supply member through the atomizing medium supply hole. Therefore, curving energy of the atomizing medium is not caused, and when the swirling liquid fuel flows into the injection nozzle, it is not obstructed by the atomizing medium. Accordingly, it is not necessary to increase a difference between the pressure of the atomizing medium and that of the liquid fuel, so that there is no possibility of misfire, and it becomes possible to increase a turndown ratio.

It is preferable to provide the aforementioned plurality of injection nozzles in the following manner: the injection nozzles are divided into a plurality of groups, wherein each group includes two injection nozzles; the plurality of injection nozzle groups are disposed around the central axis of the burner in the circumferential direction being separated from each other by a predetermined angle; and the injection nozzles in each group are disposed around the central axis of the burner in the circumferential direction so that the injection nozzles are located close to each other.

As a result of the foregoing, the flame can be divided into a plurality of independent small flames, and the small flames can be dispersed. Therefore, the radiating properties can be improved, and the flame temperature can be lowered. When the thickness of flame layers is reduced, the residence time of gas in a high temperature region can be shortened. As a result, the generation of NOx can be effectively inhibited.

Especially, it is preferable to dispose the injection nozzles in each group so that the central axes of the injection nozzles form an angle of not more than 20° or the injection nozzles are disposed close to each other in parallel.

Moreover, the fuel supply member can be composed of an approximate cylinder, the end surface of which is formed to be a conical surface.

Moreover, an engagement pin may be implanted in the joint portion between the circumferential surface of the end portion of the fuel supply member and that of the rear end portion of the burner tip so that the fuel supply member and the burner tip can be engaged with each other.

Moreover, a cutout portion capable of engaging with the end portion of the fuel supply member may be formed on the rear surface of the burner tip, and the entire burner tip may be formed into an approximate cone.

Moreover, the annular space may be composed of: a step portion provided on the upper surface circumferential portion of the fuel supply member so that the step portion is located on a level lower than the communicating cutout groove on the central side of the upper surface; and extension portion provided in the circumferential portion of the bottom surface of the burner tip and extended downward; and a bottom surface of the burner tip.

Moreover, it is preferable that one communicating cutout groove is provided so as to communicate the upper surface cutout portion with the side portion of the end of the atomizing medium supply hole, and that two communicating cutout grooves are provided so as to communicate the annular space with the side portion of the end of the atomizing medium supply hole.

With reference to an embodiment shown in the attached drawings, the present invention will be explained in detail as follows. The present invention will be apparent from the following more particular description of the embodiment. However, it should be understood that the present invention is not limited to the specific embodiment, and variations may be made by one skilled in the art without departing from the scope of the invention.

BRIEF DESCRIPTION OF THE DRAWINGS

FIG. 1 is a longitudinal sectional view showing an embodiment of the burner for burning liquid fuel of the present invention, wherein FIG. 1 is a sectional view taken on line A—A' in FIG. 3;

DETAILED DESCRIPTION OF THE PREFERRED EMBODIMENT

Figure 1:
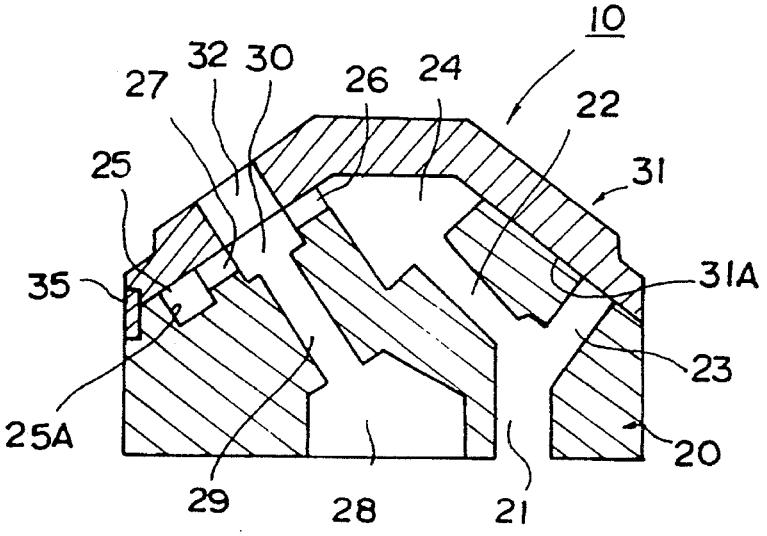
Figure 2:
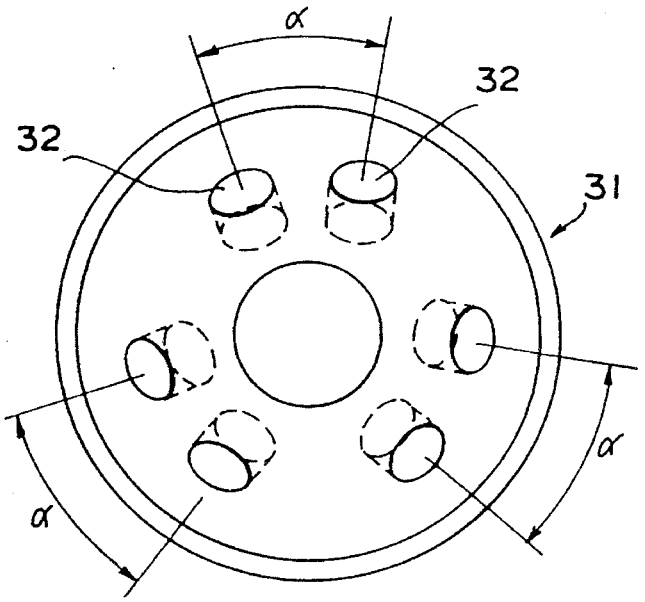
FIG. 2 is an upper view of a burner tip in the embodiment.
Figure 3:
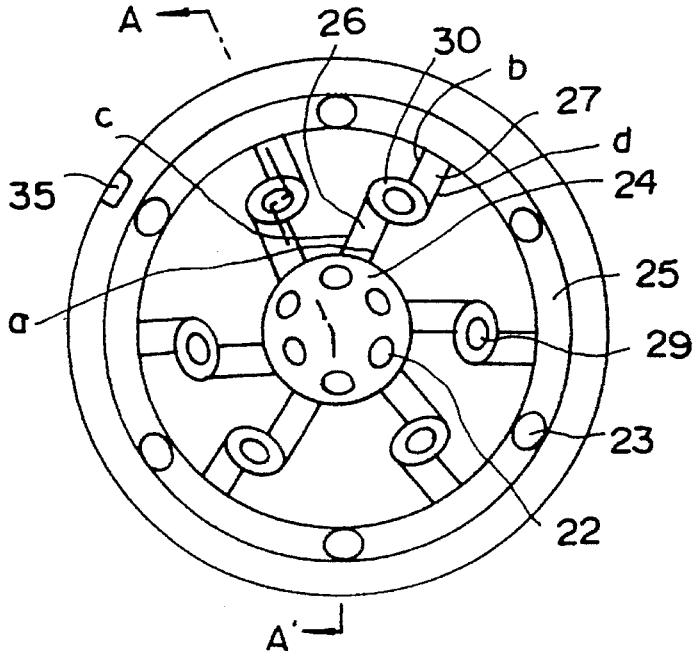
FIG. 3 is an upper view of a fuel supply member in the embodiment.

As shown in FIGS. 1 to 3, a burner 10 is composed of a fuel supply member 20 and a burner tip 31 connected with an upper surface of the fuel supply member 20. The fuel supply member 20 is made of an approximate cylinder, the end surface of which is formed of a cone.

A cutout portion (referred to as a bottom surface cutout portion hereinafter) 28 is formed in the center of the bottom surface of the fuel supply member 20. The fuel supply member 20 is provided with an atomizing medium supply hole 29 that is communicated with the bottom surface cutout portion 28 and also communicated straight with a plurality of injection nozzles 32 provided to the burner tip 31. An opening 30 of the atomizing medium supply hole 29 formed on the upper surface of the fuel supply member 20 is formed in such a manner that the opening 30 has a large diameter which is the same as that of the injection nozzle 32. The fuel supply member 20 includes a liquid fuel supply hole 21, one end portion of which is open to the circumferential portion on the bottom surface of the fuel supply member 20. The other end portion of the liquid fuel supply hole 21 is divided into two branch holes 22 and 23. One branch hole 23 is communicated with an annular space 25 formed between an annular groove 25A on the upper surface circumferential portion of the fuel supply member 20 and the lower surface of the burner tip 31. The other branch hole 22 is communicated with a cutout portion (referred to as an upper surface cutout portion hereinafter) 24 formed in the upper surface center of the fuel supply member 20.

Moreover, on the upper surface of the fuel supply member 20, communicating cutout grooves 27 and 26 are provided, wherein the communicating cutout groove 27 communicates the annular space 25 with a side of the opening 30 of the atomizing medium supply hole 29, and the communicating cutout groove 26 communicates the upper surface cutout portion 24 with a side of the opening 30 of the atomizing medium supply hole 29.

On the other hand, on the rear side of the burner tip 31, an engaging portion 31A, which is a cutout portion, is formed so that engaging portion 31A can be engaged with the end portion of the fuel supply member 20. Therefore, the entire profile is formed into an approximate cone.

The injection nozzle 32 is formed in the circumferential portion of the burner tip 31, penetrating through the burner tip 31.

An engagement pin 35 is implanted in a joint portion between the circumferential surface of the end portion of the fuel supply member 20 and that of the rear end portion of the burner tip 31 so that the fuel supply member 20 and the burner tip 31 can be secured to each other.

In the burner constituted in the aforementioned manner, the connecting direction of the communicating cutout grooves 26 and 27 connected the side of the opening 30 of each atomizing medium supply hole 29 is set in a tangential direction of the opening 30.

In FIG. 3, the side walls "a" and "b", which are one of the side walls of the communicating cutout grooves 26 and 27, are disposed on a line passing through the center of the opening 30 of the atomizing medium supply hole 29. The side walls "c" and "d", which are the other of the side walls of the communicating cutout grooves 26 and 27, are in parallel with the side walls "a" and "b", and disposed on a line in the tangential direction of the opening 30 of the atomizing medium supply hole 29.

A plurality of injection nozzles 32 are divided into a plurality of groups including two injection nozzles 32. The groups of the injection nozzles 32 are disposed around the center line of the burner 10 in the circumferential direction at regular intervals.

That is, as shown in FIG. 2, six injection nozzles 32 are provided, and these injection nozzles 32 are divided into three groups. The three groups are disposed in three positions around the center line of the burner tip 31 in such a manner that they are located at an interval of 120° in the circumferential direction.

The injection nozzles 32 in each group are disposed being close to each other in such a manner that the center lines of the injection nozzles 32 form a predetermined angle α (not more than 20°).

The injection nozzles 32 in each group may be disposed in the adjoining positions in such a manner that the center lines of the injection nozzles 32 are in parallel.

The operation of the burner for burning liquid fuel constituted in the manner described above will be explained as follows. Liquid fuel is supplied to the bottom surface of the fuel supply member 20, and reaches the liquid fuel supply hole 21, and then flows into the branch holes 22 and 23.

Liquid fuel that has flown into the branch hole 22 reaches the communicating cutout groove 26 through the upper surface cutout portion 24 of the fuel supply member 20. The communicating cutout groove 26 is open to the opening 30 of the atomizing medium supply hole 29, and the liquid fuel is injected into the atomizing medium supply hole 29 from the inner circumferential surface of the opening 30. Then, the injected liquid fuel reaches the injection nozzle 32.

The liquid fuel that has flown into the branch hole 23 reaches the communicating cutout groove 27 through the annular space 25. The communicating cutout groove 27 is open to the opening 30 of the atomizing medium supply hole 29, and the liquid fuel is injected into the atomizing medium supply hole 29 from the inner circumferential surface position of the opening 30 opposed to the opening position of the communicating cutout groove 26. Then, the injected liquid fuel reaches the injection nozzle 32.

On the other hand, steam, which is used as an atomizing medium, flows into the atomizing medium supply hole 29 from the bottom cutout portion 28 of the fuel supply member 20.

The steam that has flown into atomizing medium supply hole 29 is injected into the injection nozzle 32 through the opening portion.

The communicating cutout grooves 26, 27 and the side walls "a", "b" are provided so that they pass through almost the center of the opening 30 of the atomizing medium supply hole 29, and the side walls "c", "d" are provided so that they are in parallel with the side walls a, b and in a tangential direction of the atomizing medium supply hole 29. Consequently, when liquid fuel is injected from the two positions opposed to each other on the inner circumferential surface of the opening 30 of the atomizing medium supply hole 29, the flows of liquid fuel are respectively swirled.

Steam is injected against the swirling flows of liquid fuel formed in the aforementioned manner, and the liquid fuel and steam are mixed and atomized by the injection nozzle 32. At this time, the particles of liquid fuel mixed with steam are made to be minute and uniform by the expansion energy generated when steam is injected from the high to the low pressure side. Also, the flow of liquid fuel is swirled, and a centrifugal force is generated in the flow. By this centrifugal force, the particles of liquid fuel are made to be further minute and dispersed, so that the particles are uniformly dispersed in a wide range. Moreover, the particles of liquid fuel are shorn by steam, so that the particles are more effectively made to be minute.

As a result of the foregoing, the combustibility can be improved, and the generation of NOx can be inhibited.

Especially, since only the flow of liquid fuel is swirled and the flow of steam is not swirled, an amount of frictional energy generated between steam and liquid fuel is small, so that the steam consumption can be reduced. As a result of the reduction of steam consumption, it is not necessary to raise the heating temperature of liquid fuel. Therefore, the generation of NOx can be more effectively reduced.

Moreover, the injection nozzles 32 are divided into three groups, and the three groups are disposed in three positions around the center line of the burner tip 31 in such a manner that they are located at an interval of 120° in the circumferential direction, and further the injection nozzles 32 in each group are disposed being close to each other in such a manner that the center lines of the injection nozzles 32 form a predetermined angel α (not more than 20°) or the center lines of the injection nozzles 32 are in parallel. Accordingly, the flame can be divided into a plurality of independent small flames, and moreover the flames can be dispersed, so that the radiating properties can be improved and the flame temperature can be lowered, and the flame layer becomes thin. Accordingly, the residence time of combustion gas in a high temperature region can be shortened. As a result, the generation of NOx can be effectively inhibited.

The effect of the burner for burning liquid fuel of the present invention will be apparent from the experimental results shown in the following Tables 1 to 3.

TABLE 1

| | Conventional Burner | Burner of the Present Invention |
|---|---|---|
| Boiler Capacity t/h | 30 | 30 |
| Atomizing System | Intermediate mixing | Intermediate Mixing |
| Number of Burners | 2 | 2 |
| Size of Injection Nozzle × Number | 3.5ϕ × 6 holes | 3.5ϕ × 6 holes |
| Arrangement of Injection Nozzles × Division Angle | Uniform 6 × 60° | 3 Division × 10° |
| Boiler Evaporation Amount t/h | 20.5 | 20.5 |
| Fuel Oil | C-Type Heavy Oil | C-Type Heavy Oil |
| Combustion Oil Amount l/h | 1550 | 1550 |
| Atomizing Oil Pressure kg/cm$^2$ | 7.5 | 7.5 |
| Atomizing steam Pressure kg/cm$^2$ | 9.0 | 9.0 |
| Exhaust Gas $O_2$ % | 3.0 | 3.0 |
| $NO_x$ Concentration ppm | 203 | 151 |

TABLE 1-continued

| | Conventional Burner | Burner of the Present Invention |
|---|---|---|
| Reduction Ratio % | Standard | 25.6 |
| Dust Concentration mg/Nm$^3$ | 120 | 60 |
| Reduction Ratio % | Standard | 50 |

TABLE 2

| | Conventional Burner | Burner of the Present Invention |
|---|---|---|
| Boiler Capacity t/h | 30 | 30 |
| Atomizing System | Intermixing | Intemediate Mixing |
| Number of Burners | 4 | 4 |
| Injection Nozzle Size × Number Upper 2 Nozzles | 3.0ϕ × 8 holes | 3.3ϕ × 6 holes |
| Injection Nozzle Size × Number Lower 2 Nozzles | 3.7ϕ × 8 holes | 3.5ϕ × 6 holes |
| Injection Nozzle Arrangement × Division Angle Upper 2 Nozzles | Uniform 8 × 45° | 3 Division × 15° |
| Injection Nozzle Arrangement × Division Angle Lower 2 Nozzles | Uniform 8 × 45° | 3 Division × 7.5° |
| Boiler Evaporation Amount t/h | 25.5 | 25.5 |
| Fuel Oil | C-Type Heavy Oil | C-Type Heavy Oil |
| Combustion Oil Amount l/h | 1950 | 1950 |
| Atomizing Oil Pressure kg/cm$^2$ | 4.5 | 5.0 |
| Atomizing Steam Pressure kg/cm$^2$ | 5.5 | 6.0 |
| Exhaust Gas $O_2$ % | 3.0 | 3.0 |
| $NO_x$ Concentration ppm | 200 | 165 |
| Reduction Ratio % | Standard | 17.5 |
| CO Concentration | 50 | 25 |
| Reduction Ratio % | Standard | 50 |
| Exhause Gas Concentration Ringelmann | 1.55 | 1.45 |

TABLE 3

| | Conventional Burner | Burner of the Present Invention |
|---|---|---|
| Boiler Capacity t/h | 57 | 57 |
| Atomizing System | Intermediate Mixing | Intermediate Mixing |
| Number of Burners | 4 | 4 |
| Injection Nozzle Size × Number Upper 2 Nozzles | 3.3ϕ × 6 holes | 3.6ϕ × 6 holes |
| Injection Nozzle Size × Number Lower 2 Nozzles | 3.6ϕ × 6 holes | 3.9ϕ × 6 holes |
| Injection Nozzle Arrangement × Division Angle Upper 2 Nozzles | 3 Division × 20° | 3 Division × 0° |
| Injection Nozzle Arrangement × Division Angle Lower 2 Nozzles | 3 Division × 20° | 3 Division × 0° |
| Burner Capacity Upper 2 Burners l/h | 900 | 900 |
| Burner Capacity Lower 2 Burners | 1300 | 1300 |

TABLE 3-continued

| | Conventional Burner | | Burner of the Present Invention |
|---|---|---|---|
| l/h | | | |
| Addition of water (to Combustion Oil Amount) | No | 15 | No |
| Boiler Evaporation Amount t/h | 49.6 | 49.6 | 49.9 |
| Fuel Oil | C-Type Heavy Oil | | C-Type Heavy Oil |
| Combustion Oil Amount l/h | 3760 | 3760 | 3690 |
| Atomizing Oil Pressure kg/cm$^2$ | 7.3 | 7.3 | 6.9 |
| Atomizing Steam Pressure kg/cm$^2$ | 8.9 | 8.9 | 7.2 |
| Exhaust Gas $O_2$ % | 1.65 | 1.65 | 22 |
| $NO_x$ Concentration ppm | 240 | 207 | 180 |
| Reduction Ratio % | Standard | 13.8 | 25 |
| Smoke Concentration (ASTM Standard) | 5 | 5 | 4 |

According to the experimental results shown in Table 1, the reduction ratio of NOx was 25.6%, and that of soot and dust was 50%. According to the experimental results shown in Table 2, the reduction ratio of NOx was 17.5%, and that of CO was 50%. According to the experimental results shown in Table 3, the reduction ratio of NOx was 25%. It is apparent that the concentrations of NOx and CO, and the amount of soot and dust were reduced.

As can be seen in Table 3, when a comparison is made between the conventional burner in which angle α formed by two adjoining injection nozzles was 20° and water was added by 15%, and the burner of the present invention in which angle α formed by two adjoining injection nozzles was 0°, that is, the two burners were disposed in parallel, the reduction ratio of NOx of the burner of the present invention is higher than that of the conventional burner. As can be seen in Table 3, when angle α formed by two adjoining injection nozzles was not more than 20°, more excellent results were provided, for example, the reduction ratio of NOx was higher.

In the burner structure described above, the fuel supply member 20 includes: the atomizing medium supply hole 29 communicated with the bottom cutout portion 28 and also communicated straight with a plurality of injection nozzles 32 formed in the burner tip 31; the liquid fuel supply hole 21, one end portion of which is open to the periphery of the bottom surface of the fuel supply member 20, the other end portion of which branches in two directions, one branch being communicated with the annular space 25 formed between the annular groove 25A of the upper surface periphery of the fuel supply member 20 and the lower surface of the burner tip 31, the other branch being communicated with the upper surface cutout portion 24 formed in the center of the upper surface of the fuel supply member 20; and communicating cutout grooves 27, 26 that respectively communicate the annular space 25 formed on the upper surface of the fuel supply member 20 and the upper surface cutout portion 24 with the side portion of the atomizing medium supply hole 29. Accordingly, the following advantages can be provided.

That is, since the fuel supply member 20 includes a swirling section for liquid fuel and a shearing section for liquid fuel in which liquid fuel particles are shorn by an atomizing medium, the structure of the burner tip can be simplified as compared with a case in which the swirling section for liquid fuel is formed in the injection nozzle portion on the bottom surface of the burner tip by means of machining, so that the burner tip can be easily manufactured. Also, a portion of the length of the injection nozzle is not taken for the shearing swirl portion. Therefore, sufficient length of the mixing portion of the injection nozzle in which fuel and atomizing medium are mixed can be provided, so that the mixing properties can be improved. Moreover, in the case where the atomizing angle of the injection nozzle and the division angle formed between two adjoining injection nozzles are slightly changed, a burner tip to meet the requirement can be easily manufactured, that is, the angles of the burner tip can be changed when the burner tip is machined a little, so that the manufacturing properties can be improved.

Also, the atomizing medium can be sent straight to the injection nozzle 32 of the burner tip 31 from the center of the fuel supply member 20 through the atomizing medium supply hole 29. Therefore, curving energy of the atomizing medium is not generated, and there is no possibility that the swirling flow of liquid fuel supplied into the injection nozzle 32 is obstructed by the flow of atomizing medium. Accordingly, it is not necessary to increase the difference of pressure between the atomizing medium and the liquid fuel. As a result, the occurrence of misfire can be avoided, so that a turndown ratio can be increased.

Table 4 shows the result of an experiment by which the improvement in the turndown ratio was ensured. This experiment was carried out under the condition that the atomizing steam pressure was maintained to be a constant value of 5.7 kg/cm$^2$ G and the atomizing heavy oil pressure was changed stepwise in order to check the maximum value of load for which atomized heavy fuel was stably burnt.

TABLE 4

| Load (T/H) | Heavy Oil Flow (l/H) | Oil Pressure (kg/cm$^2$) | Steam Pressure (kg/cm$^2$) |
|---|---|---|---|
| [Case in which curved atomizing medium supply holes were provided] 4 burners | | | |
| 50 | 3880 | 5.7 | 5.7 |
| 45 | 3000 | 5.1 | 5.7 |
| 38 | 2910 | 4.5 | 5.7 |
| 32 | 2400 | 3.9 | 5.7 |
| [Case in which straight atomizing medium supply holes were provided] 4 burners | | | |
| 50 | 3890 | 5.7 | 5.7 |
| 48 | 3480 | 5.1 | 5.7 |
| 38 | 2900 | 4.6 | 5.7 |
| 32 | 2400 | 3.7 | 5.7 |
| 25.5 | 1920 | 3.0 | 5.7 |
| 20.5 | 1540 | 2.5 | 5.7 |
| 17.5 | 1320 | 2.2 | 5.7 |
| The following tests were omitted. | | | |

Specification of the tested burners?
Upper two burners: 1.2ϕ × 6h × 80° Division angle 20°
Lower two burners: 4.5ϕ × 6h × 80° Division angle 7.5°

As can be seen in the experimental result, in the case of the burners of the present invention, stable and excellent combustion was made even when the load was light, so that it was possible to adopt a high turndown ratio. Moreover, one type burner can be applied to a wide combustion range from light to heavy load. In the case of conventional burners, when the load is light, combustion is made in an unstable condition, so that excellent combustion can not be made. Consequently, it is necessary to provide several type of burners such as a burner for use in light, middle and heavy loads.

Figure 4:
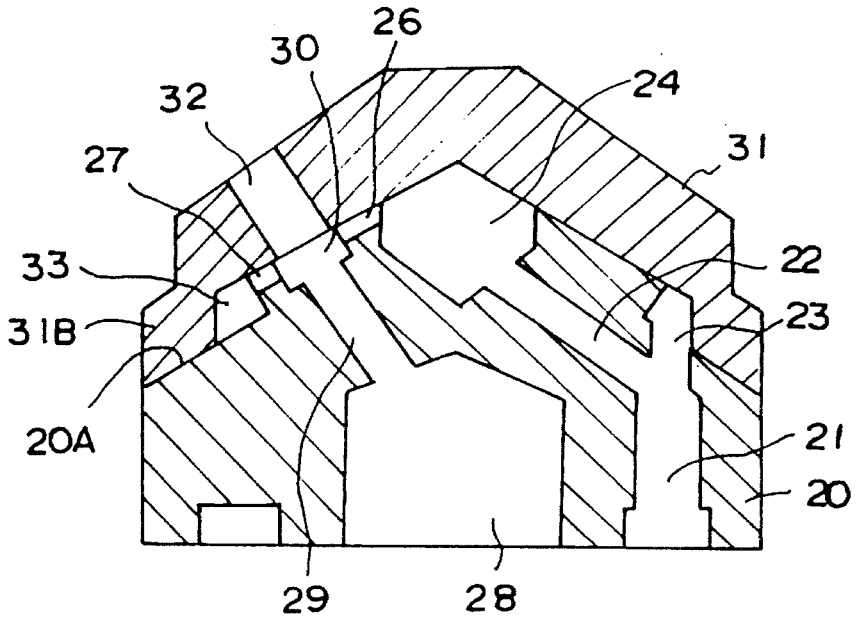
FIG. 4 is a longitudinal sectional view of another embodiment.

Next, with reference to FIGS. 4 to 6, another embodiment of the present invention will be explained as follows.

This embodiment is different from the previous one in the following points. With respect to other points, this embodiment is the same as the previous one.

On an upper surface circumferential portion of the fuel supply member 20, a step portion 20A is formed in such a manner that the step portion 20A is located on a lower level than a portion in which the communicating cutout grooves 26 and 27 on the upper surface center side of the fuel supply member 20 are formed. On the other hand, an extension portion 31B extended downward is provided in the bottom circumferential portion of the burner tip 31, so that an annular space 33 into which liquid fuel flows from the branch hole 23 is formed by the bottom surface of the burner tip 31, the extension portion 31B and the step portion 20A.

Figure 5:
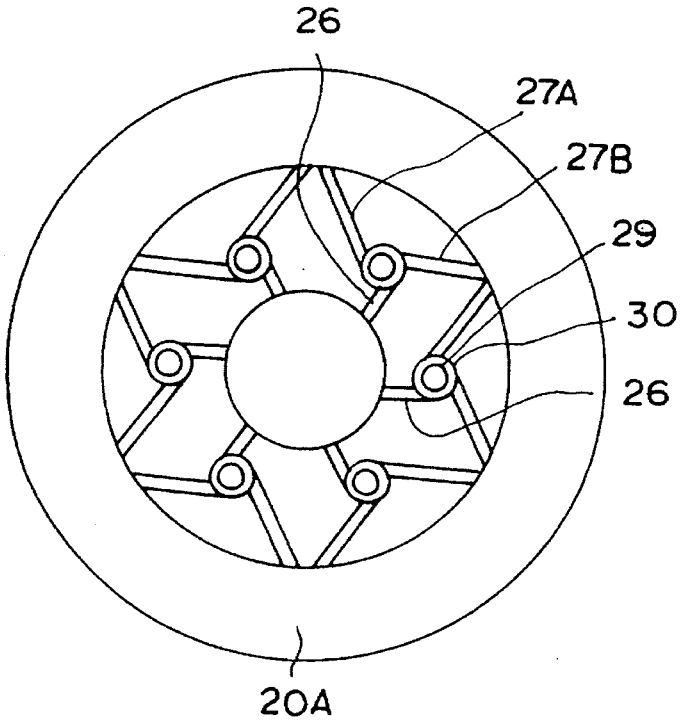
FIG. 5 is an upper view of a fuel supply member of another embodiment described above.
Figure 6:
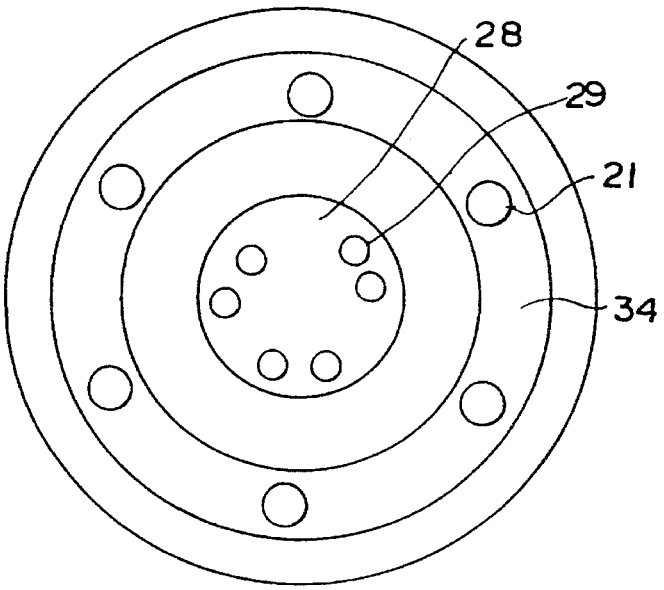
FIG. 6 is a lower view of the fuel supply member of another embodiment described above.

In this connection, as shown in FIG. 5, two communicating cutout grooves 27A and 27B are formed which communicate the annular space 33 with the side portion of the opening 30 of the atomizing medium supply hole 29, and fuel flows into each atomizing medium supply hole 29 from three communicating cutout grooves 26, 27A and 27B. As a result of the foregoing, liquid fuel is more effectively swirled, so that the particles of fuel can be effectively made to be minute.

We claim:

1. A burner for burning liquid fuel comprising a fuel supply member and a burner tip connected with the end portion of the fuel supply member, the burner tip including a plurality of injection nozzles by which liquid fuel and atomizing medium mixed in the liquid fuel are atomized and injected into a combustion device, the fuel supply member including: a bottom surface cutout portion formed in the center of a bottom surface of the fuel supply member for receiving an atomizing medium; atomizing medium supply holes in communication with the bottom cutout portion, each supply hole communicating in a straight alignment with one said injection nozzles of the burner tip; a liquid fuel supply hole, one end portion of which is open to the periphery of the bottom surface of the fuel supply member, the other end portion of which branches in two directions, one branch being communicated with an annular space formed between the periphery of the upper surface of the fuel supply member and the lower surface of the burner tip, the other branch being communicated with an upper surface cutout portion formed in the center of the upper surface of the fuel supply member; and communicating cutout grooves that respectively communicate the annular space formed on the upper surface of the fuel supply member and the upper surface cutout portion with the side portion of the end of the atomizing medium supply hole, wherein each communicating cutout groove tangentially connects with the side portion of the end of the atomizing medium supply hole, wherein one of the communicating cutout grooves is provided so as to communicate the upper surface cutout portion with the side portion of the end of the atomizing medium supply hole, and two communicating cutout grooves are provided so as to communicate the annular space with the side portion of the end of the atomizing medium supply hole.

2. The burner for burning liquid fuel according to claim 1, wherein said injection nozzles comprise groups, each group including two injection nozzles, said groups being disposed around the central axis of the burner in the circumferential direction, each said group being separated from an adjacent group by a predetermined angle, and the injection nozzles in each group being disposed around the central axis of the burner in the circumferential direction so that the injection nozzles of each group are located close to each other.

3. The burner for burning liquid fuel according to claim 2, wherein the injection nozzles in a said group are disposed so that the central axes of the injection nozzles form an angle not more than 20° or the injection nozzles are disposed close to each other in parallel.

4. The burner for burning liquid fuel according to claim 1, wherein the fuel supply member is composed of an approximate cylinder, the end surface of which is formed to be a conical surface.

5. The burner for burning liquid fuel according to claim 1, wherein an engagement pin is implanted in a joint portion between the circumferential surface of the end portion of the fuel supply member and that of the rear end portion of the burner tip so that the fuel supply member and the burner tip can be engaged with each other.

6. The burner for burning liquid fuel according to claim 1, wherein a cutout portion capable of engaging with the end portion of the fuel supply member is formed on the rear surface of the burner tip, and the entire burner tip is formed into an approximate core.

7. The burner for burning liquid fuel according to claim 1, wherein the annular space is composed of: a step portion provided on the upper surface circumferential portion of the fuel supply member so that the step portion is located on a level lower than the communicating cutout groove on the central side of the upper surface; an extension portion provided in the circumferential portion of the bottom surface of the burner tip and extended downward.

8. The burner of claim 1 wherein each of the communicating cutout grooves open into a side portion of the end of the atomizing medium supply hole tangentially such that one side of each said communicating cutout groove tangentially intersects a side wall of said side portion with the opposite side of each said communicating cutout groove intersecting said side wall of said side portion on a line spaced from a line intersecting a center of said atomizing medium supply hole such that fuel entering said end of the atomizing medium supply hole is swirled along said side wall of said atomizing medium supply hole end thereby making minute particles of fuel.

* * * * *